United States Patent [19]

Foroulis

[11] 4,108,790

[45] Aug. 22, 1978

[54] CORROSION INHIBITOR

[75] Inventor: Zisis Andrew Foroulis, Mendham, N.J.

[73] Assignee: Exxon Research & Engineering Co., Linden, N.J.

[21] Appl. No.: 604,918

[22] Filed: Aug. 15, 1975

Related U.S. Application Data

[63] Continuation-in-part of Ser. No. 195,081, Nov. 2, 1971, abandoned, Ser. No. 140,125, May 4, 1971, abandoned, Ser. No. 104,477, Jan. 6, 1971, Pat. No. 3,711,246, and Ser. No. 91,612, Nov. 20, 1970, abandoned, said Ser. No. 140,125, is a continuation-in-part of Ser. No. 820,303, Apr. 29, 1969, abandoned.

[51] Int. Cl.[2] ..... C23F 11/12; C23F 11/16

[52] U.S. Cl. ..... 252/175; 21/2.5 R; 21/2.7 R; 106/14.12; 210/59; 252/389 A; 252/396

[58] Field of Search ..... 252/389 A, 175, 80, 252/82, 83, 85, 86, 87, 181, 396; 21/2.7 A, 2.7 R, 2.5 A, 2.5 R; 210/59; 106/14

[56] References Cited

U.S. PATENT DOCUMENTS

| | | | |
|---|---|---|---|
| 3,256,203 | 6/1966 | Robertson et al. | 252/389 A |
| 3,483,033 | 12/1969 | Casey | 252/181 |

*Primary Examiner*—Benjamin R. Padgett
*Assistant Examiner*—Irwin Gluck
*Attorney, Agent, or Firm*—Roy J. Ott

[57] ABSTRACT

Oxidative corrosion in cooling water systems containing chlorine to prevent bacterial growth is effectively inhibited by the addition of small amounts of a water-soluble polyphosphate and a water-soluble gluconate. Specific examples of salts are sodium hexametaphosphate and sodium gluconate. The combination of a polyphosphate and a gluconate results in a synergistic improvement of corrosion inhibition.

13 Claims, 1 Drawing Figure

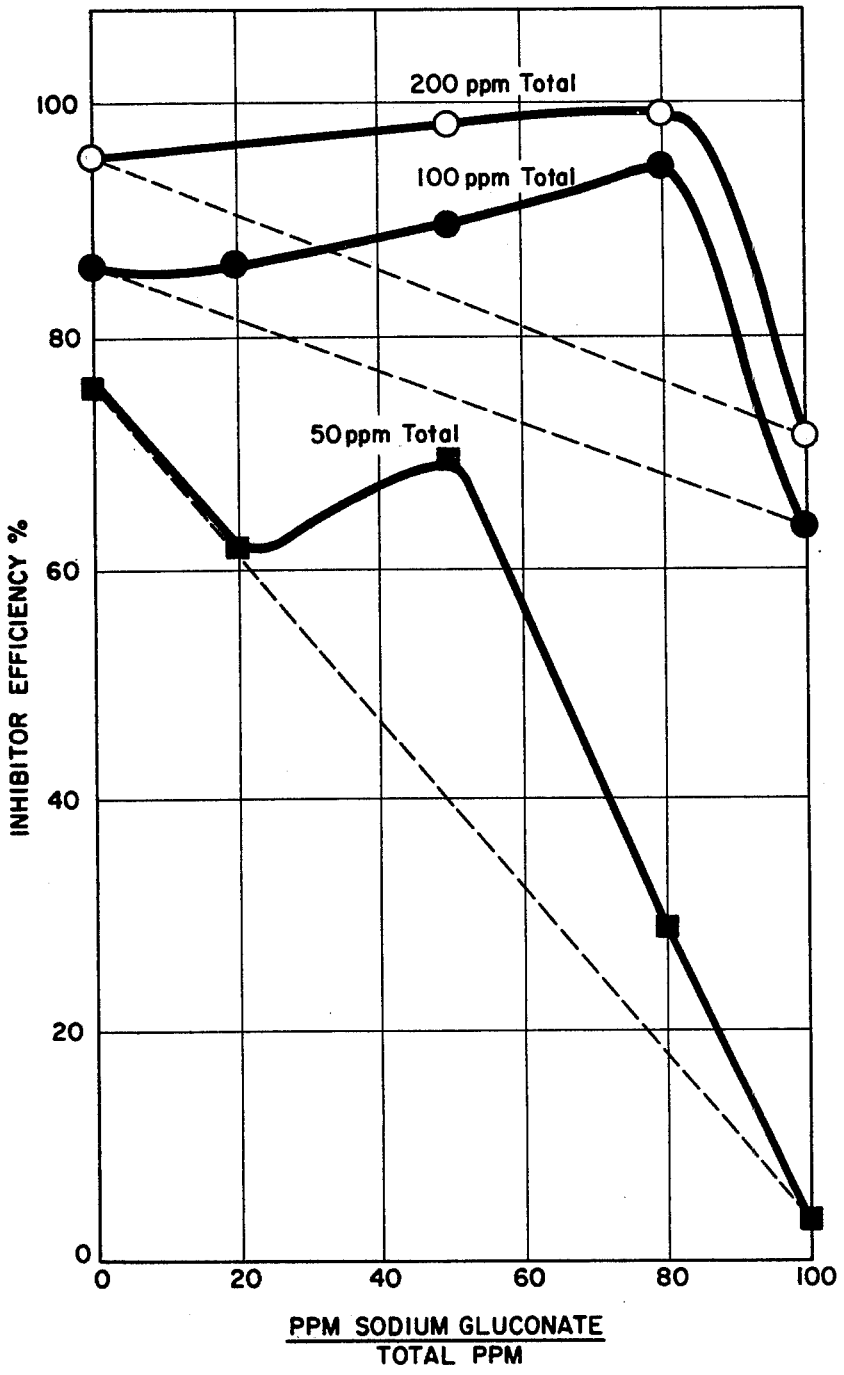
200 ppm Total
100 ppm Total
50 ppm Total
INHIBITOR EFFICIENCY %
100
80
60
40
20
0
0
20
40
60
80
100
PPM SODIUM GLUCONATE
TOTAL PPM

CORROSION INHIBITOR

CROSS-REFERENCE TO RELATED APPLICATIONS

This application is a continuation-in-part of my copending application Ser. No. 195,081, filed Nov. 2, 1971 now abandoned and Ser. No. 140,125, filed May 4, 1971, now abandoned, which in turn is a continuation-in-part of my application Ser. No. 820,303, filed Apr. 29, 1969, now abandoned. This application is also a continuation-in-part of my copending application Ser. No. 91,612, filed Nov. 20, 1970, now abandoned, and my copending application Ser. No. 104,477, filed Jan. 6, 1971, now U.S. Pat. No. 3,711,246.

BACKGROUND OF THE INVENTION

This invention relates to methods and compositions for preventing oxidative corrosion of metals by aqueous solutions. In particular, this invention relates to methods of inhibiting oxidative corrosion in recirculating cooling water systems, and to corrosion inhibiting compositions which are useful in such systems.

Cooling water systems are widely used in oil refineries and in chemical plants, as well as in homes, factories, and public buildings. Each day huge volumes of water are being circulated through tremendous numbers of such systems. This obviously represents a large dollar volume in capital investment and operating expense. It also requires large amounts of cooling water.

Cooling water systems may be classified generally into two types. One type is the once-through cooling system, where cooling water is picked up from a convenient source, such as a river, sent once through the cooling equipment, and then discharged. Corrosion problems in such systems are generally minor. However, in most localities, cooling water is not sufficiently abundant to permit the use of a once-through system, and the number of such systems is on the decrease.

The other general type of cooling water system is the recirculating cooling water system. Recirculating systems include a cooling tower or equivalent type of equipment, where heated water from the system's heat exchanger is contacted with air from the atmosphere. During the course of such contact with air, a substantial amount of air dissolves in the cooling water and is circulated throughout the cooling system. The oxygen dissolved in the water diffuses to the water metal interface and will produce corrosion in the heat exchangers and on the metal pipes and vessels in the cooling system. Admiralty metal, copper and steel, particularly carbon steels, are the most commonly used materials in such systems, and unfortunately such materials are particularly prone to oxidative attack.

Another problem encountered in recirculating cooling water systems is the formation of scale on metal surfaces. This is due primarily to the precipitation of calcium salts and especially calcium carbonate. Iron oxides and hydroxides, formed by oxidation of iron metal in the system, can also contribute to scale formation. Even soft waters can cause some scale formation from calcium compounds, since the concentration of calcium compounds in the cooling water is several times as great as their concentration in the inlet water due to the evaporation of water in the cooling tower of the system.

The prior art has attempted to inhibit oxidative corrosion in water cooling systems by introducing various inorganic inhibitor systems which produce thin metal oxide films on the metal surfaces of the cooling systems so as to retard or hopefully prevent the diffusion of oxygen to the metal surfaces. Systems which have achieved wide acceptance in the art for this purpose include chromate and phosphate salts. Unfortunately, these systems have serious drawbacks when used as corrosion inhibitors.

Chromates under certain conditions can give rise to accelerated corrosion. For example, chromates can promote pitting when introduced in low concentrations. This pitting attack may be quite serious and may result in perforation, particularly in areas of breaks or discontinuities in the film produced by the chromate inhibitor. Since setting up virtually perfect thin film in large scale equipment with high flow conditions is tricky to say the least, it is safe to say that effective inhibition will be most unpredictable from unit to unit, and even from day to day in the same unit.

A further and most serious drawback in the use of chromates as inhibitors arises from the fact that chromates are pollutants. Chromates have toxic properties and their presence in streams and rivers is coming under even stricter control in new anti-pollution laws. Thus, in order to be able to circulate used cooling water with an environmental sewage system, it would be necessary for the cooling system operator to install adequate purification equipment to remove the chromate prior to water disposal. As a practical matter, it is very difficult and prohibitively expensive to remove chromate to an adequately low level, with the result that chromate is rapidly falling into disuse as a corrosion inhibitor.

Polyphosphates have also been used as corrosion inhibitors but with little success. These substances at very low concentrations act as sequestering agents for calcium and magnesium compounds which are present in the system. In this regard, polyphosphates are useful in water treatment. Polyphosphates in higher concentrations, e.g., about 50–100 ppm, have some beneficial effect on corrosion inhibition. However, the use of polyphosphates alone as corrosion inhibitors is limited by their rapid reversion to orthophosphates, which react with calcium ions, thus both depleting the polyphosphate concentration with an attendant increase in corrosion, and creating scale of insoluble calcium orthophosphate which seriously interferes with heat transfer. This reversion to orthophosphate increases rapidly with increasing polyphosphate concentration, decreasing pH, increasing calcium content in water, and increasing temperature. Thus, although the addition of acid to reduce the pH of cooling water decreases the amount of calcium carbonate scale formation, this advantage is at least partially offset by an increase in the formation of calcium orthophosphate. Another disadvantage of polyphosphates where used alone is that they are corrosive in concentrated solutions. In addition, polyphosphates are also stream pollutants when discharged into a sewage system, although the acceptable concentration of phosphates is considerably higher than the acceptable concentration of chromates.

Tannins and their derivatives have also been used as corrosion inhibitors as disclosed in U.S. Pat. No. 3,256,203. Unfortunately, these tannin materials have serious drawbacks when used in cooling water systems containing chlorine to retard bacterial growths since they react with the chlorine to render it ineffective as a bacteriostat.

There exists, therefore, a need for a new and effective corrosion inhibitor system which will effectively inhibit corrosion of metal surfaces in cooling water systems containing chlorine while at the same time not result in excessive concentrations of pollutants which cannot be discharged into environmental sewage systems. It has previously been proposed to inhibit the corrosion of metal surfaces in cooling water systems by adding to the water an alkali metal or ammonium gluconate. Sodium gluconate has been particularly suggested for this purpose. The gluconate salts are nontoxic in the concentrations utilized and pose no pollution problems if discharged into an environmental waste water system. Gluconates have been found to be effective for preventing corrosion. Gluconates are generally effective at concentrations of about 100 ppm or higher; however, they lose their effectiveness rapidly at concentrations below about 100 ppm.

SUMMARY OF THE INVENTION

An object of this invention is to provide a new inhibitor combination for preventing oxidative corrosion of metal parts in cooling water systems at low concentrations. A further object of this invention is to provide a corrosion inhibitor combination which is non-toxic and will not pose a pollution problem when purged into an environmental waste water system with used cooling water.

It has been found that small amounts of an inhibitor combination of a water-soluble inorganic gluconate salt and a water-soluble inorganic polyphosphate salt is effective as an oxidative corrosion inhibitor in cooling water systems containing a bacteriostat such as chlorine or compounds thereof. The alkali metal and ammonium gluconates, and the alkali metal and ammonium polyphosphates, are preferred. Good corrosion inhibition is obtained when the total inhibitor concentration is in excess of about 25 ppm, and preferably about 50 to about 200 ppm. Best results are obtained when the gluconate and the polyphosphate are added to the cooling water in the proportions of about 30 to about 90 parts by weight of the water-soluble gluconate and conversely about 70 to about 10 parts by weight of the water-soluble polyphosphate. The combination of gluconate and polyphosphate exhibits a synergistic effect on inhibiting corrosion which cannot be predicted on the basis of the corrosion inhibition achieved with polyphosphate or with gluconate alone.

THE DRAWING

The sole FIGURE of the drawing is a graph showing the effectiveness of various combinations of sodium gluconate and sodium hexametaphosphate as corrosion inhibitors.

DESCRIPTION OF THE PREFERRED EMBODIMENT

Preferred polyphosphates for use in the present invention are the water-soluble inorganic hexametaphosphates, and particularly the alkali metal and ammonium hexametaphosphates. Sodium hexametaphosphate is a preferred salt of this type.

The preferred inorganic water-soluble gluconate salts are the alkali metal and ammonium gluconates. In particular, lithium gluconate, sodium gluconate, potassium gluconate, and ammonium gluconate are imminently suitable for use herein. The most preferred salt costwise is sodium gluconate.

The combined concentration of gluconate salt and polyphosphate salt is in the range of about 25 to about 1000 ppm, and preferably about 50 to about 200 ppm. When the combined concentration of polyphosphate and gluconate is within the preferred range, excellent corrosion inhibition is obtained, and the percentage inhibition is considerably greater than if an equal concentration of gluconate alone were used. In fact, the corrosion inhibition obtained with a combination of polyphosphate and gluconate within this preferred range is frequently greater than the corrosion inhibition obtained with polyphosphate alone. It must be noted also that use of polyphosphates alone, even in concentrations as low as 20–30 ppm, cannot be used as a corrosion inhibitor because in most cooling water systems the calcium concentration, pH and temperature encountered therein, cause the polyphosphates to partially revert to orthophosphates and lead to calcium orthophosphate deposits which interfere with heat transfer in heat exchangers. Furthermore, the use of the combination of polyphosphate and gluconate instead of polyphosphate alone has the added advantage that the discharge of excessive polyphosphate concentrations into environmental waste water systems is avoided. To establish corrosion inhibition initially, a polyphosphate and a gluconate are added in amounts giving a combined concentration of at least 50 ppm and preferably about 100 to about 200 ppm. Concentrations of 25 to 50 ppm of combined inhibitors are usually more suited to maintaining a corrosion inhibiting activity rather than in establishing such activity in the first place. A total inhibitor concentration of at least about 25 ppm and especially about 50 ppm to about 100 ppm is ordinarily preferred for maintenance of corrosion inhibitor activity. Concentrations of corrosion inhibitor above 200 ppm can be used, but generally the additional improvement with increasing inhibitor concentration in this range is slight, and the advantages of the combined polyphosphate and gluconate systems over equivalent concentrations of gluconate alone are less noticeable than in the preferred range.

The total concentration of polyphosphate in the corrosion inhibitor system of this invention is generally in the range of about 10 to about 100 ppm. At low concentrations of gluconate, particularly at concentrations less than about 100 ppm, the presence of at least 10 ppm of polyphosphate is essential in order to assure good corrosion inhibition. Furthermore, as already stated, polyphosphate performs the additional useful function of acting as the sequestering agent for calcium and magnesium ions in the cooling water. This is important where hard water is used. The desirable upper limit of polyphosphate concentration depends to a large extent on the hardness of the water. Surprisingly, the maximum concentration of polyphosphate which can be added to a cooling water system in conjunction with a gluconate according to this invention without causing calcium orthophosphate scale formation is much higher than the maximum permissible concentration of polyphosphate when used alone. However, it is desirable to keep the concentration of polyphosphates as low as possible because phosphates in high concentrations are water pollutants, causing eutrophication. For this reason, concentrations of polyphosphate in excess of about 100 ppm are generally not used.

The concentration of gluconate salt is generally at least 10 ppm, and preferably in the range of about 10 to about 200 ppm.

The concentration of the gluconate in the corrosion inhibited solution is about 30 to about 90% by weight and the concentration of the polyphosphate is conversely about 10 to about 70% by weight of the combined concentrations of gluconate and polyphosphate. Preferred gluconate concentrations are from about 30 to about 80% and especially from about 40 to about 60% of the combined gluconate-polyphosphate concentration; preferred polyphosphate concentrations are from about 20 to about 70% and preferably from about 40 to about 60% by weight of the combined gluconate-polyphosphate concentration. A preferred corrosion inhibitor is a combination of about 40 to about 60% by weight of sodium gluconate and about 40 to about 60% by weight of sodium hexametaphosphate, especially combinations of about 40% by weight of sodium gluconate and about 60% by weight of sodium hexametaphosphate. Stated another way, the corrosion inhibited solutions of this invention contain about 30 to about 90 parts by weight, preferably about 30 to about 80 parts by weight, and most preferably about 40 to about 60 parts by weight, of an alkali metal or ammonium gluconate, and conversely about 10 to about 70 parts by weight, preferably about 20 to about 70 parts by weight, and most preferably about 40 to about 60 parts by weight, of an alkali metal or ammonium polyphosphate. Combinations of a water-soluble gluconate and a water-soluble polyphosphate have been found to give a synergistic improvement in corrosion inhibition and not merely the additive effects of the two inhibitors, especially when used in the proportions indicated herein. Excellent corrosion protection is afforded by combinations of these two inhibitors, and additional inhibitors are not required.

Although additional corrosion inhibitors are not required and ordinarily are not preferred, they may be included if they are not incompatible with other constituents of the corrosion inhibited system. Thus, 2-mercaptobenzothiazole, and benzotriazole may be included in the corrosion inhibited aqueous media of this invention. Additives may be dissolved in the cooling water for purposes other than corrosion inhibition if desired. For example, it is common practice to periodically dissolve a small amount of chlorine, e.g., enough to give a concentration of about 0.5–5 parts per million (ppm), more usually 1–3 ppm of free chlorine in the cooling water to prevent the growth of bacteria; this chlorine may be supplied in the form of conventional inorganic hypochlorites such as sodium or calcium hypochlorites. As is known, the chlorine, or compound thereof, can be added continuously, but it is usually added periodically, for example, for periods of 1–2 hours at a frequency of 2 or 3 times a week in order to maintain the free chlorine level in the range of 1–3 ppm during that period of time. In accordance with this invention, it is found that the gluconate-polyphosphate inhibitor system claimed herein can be advantageously used in cooling water systems containing chlorine to prevent bacterial growth. However, the addition of substances which are oxidized by chlorine in an aqueous medium must be avoided, since such substances will deplete the chlorine and render it ineffective as a bacteriostat. Thus, the corrosion inhibited solutions of this invention should be substantially free of oxidizable organic matter, and particularly organic matter that is in the colloidal state. Tannins and their derivatives (as disclosed in the aforementioned U.S. Pat. No. 3,256,203) and lignins and their derivatives, including ligno-sulfates, are examples of substances which should not be added to the cooling water because they react with chlorine and render it ineffective as a bacteriostat. Also, orthophosphates should not be added to the cooling water because they contribute little to corrosion inhibition and tend to react with calcium ions in the water to form a precipitate which deposits as a scale on metal surfaces.

It is believed that the contact of the cooling water containing dissolved phosphate and gluconate salts in the desired concentration range with the metal surfaces of the cooling water system results in the formation of a thin protective film on those metal surfaces. This film serves to inhibit the diffusion of dissolved oxygen from the water phase to the metal surfaces, thereby substantially lowering the corrosion rate of the metal.

The inhibitor combination of polyphosphate and gluconate may be added as solids to the desired concentration. It is also possible to add the salts as a concentrated aqueous solution in amounts to yield the desired concentration. In either case, the corrosion inhibiting salts will generally be added to the make-up water feed to the cooling water system. The choice of mode of treatment is completely within the discretion of the user, and the selection is made purely on the relative convenience of the respective modes.

It is preferred to pre-mix the gluconate salt and the polyphosphate salt prior to addition to cooling water, for convenience and for accurate proportioning of the two ingredients. Mixtures of the water-soluble gluconate and the water-soluble polyphosphate in the proportions indicated herein are novel compositions according to this invention. The corrosion inhibiting compositions of the present invention include dry solid compositions containing about 30 to about 90 parts by weight of a water-soluble gluconate salt and about 10 to about 70 parts by weight of a water-soluble polyphosphate salt, particularly the alkali metal and ammonium gluconates and the alkali metal and ammonium polyphosphates as previously indicated. Preferred compositions in the present invention contain about 30 to about 80 parts by weight of a water-soluble gluconate salt and about 20 to about 70 parts by weight of a water-soluble polyphosphate salt, and especially about 40 to about 60 parts by weight of a water-soluble gluconate salt and about 40 to about 60 parts by weight of a water-soluble polyphosphate salt. Especially preferred compositions of this invention are dry solid compositions consisting essentially of about 40 to about 60 parts by weight of sodium gluconate and about 40 to about 60 parts by weight of sodium hexametaphosphate, particularly a composition of about 40 parts by weight of sodium gluconate and about 60 parts by weight of sodium hexametaphosphate. These dry solid compositions can be dissolved in water to form concentrated aqueous solutions which are suitable for addition to cooling water to form a corrosion inhibited system. Thus, the compositions of the present invention embrace concentrated aqueous solutions comprising about 30 to about 90 parts by weight of a water-soluble gluconate salt and about 10 to about 70 parts by weight of a water-soluble polyphosphate salt, and water. Preferred aqueous solutions are those containing about 30 to about 80 parts by weight, most preferably about 40 to about 60 parts by weight, of a water-soluble gluconate, and conversely about 20 to about 70 parts by weight, most preferably about 40 to about 60 parts by weight, of a water-soluble polyphosphate, and water. The concentrated solutions can be prepared in any desired concentration, usually at least 10% by weight of solids, which is convenient for addition to water as a corrosion inhibitor. Where additional solid ingredients besides the water-soluble gluconate and the water-soluble polyphosphate are desired in the corrosion inhibitor system, these can be included in either the dry solid compositions or the concentrated aqueous solutions herein described.

In some applications, a single treatment with the inhibitor will be sufficient to adequately protect a cooling water system up to two to three weeks. However, in cases where there is unusually turbulent flow or a vessel configuration which makes it difficult to preserve film integrity on the metal surfaces, or in instances where inhibitor losses are excessive, it will be necessary to repeat the addition of inhibitor to establish a total inhibitor concentration of at least about 100 ppm when a cooling water system is being started up. This will cause the protective film to form on the metal surfaces in the system. Once this film is formed, it can frequently be maintained at lower inhibitor concentrations, in many cases as low as about 25 ppm total inhibitor concentration. However, as previously indicated, it is generally preferable to maintain a total inhibitor concentration of at least 50 ppm.

The gluconate-polyphosphate inhibitor systems of the present invention are highly effective as corrosion inhibitors over a wide range of inhibitor concentrations, and over wide ranges of cooling water pH, temperature and velocity. It is possible to use polyphosphates in much higher concentrations in the gluconate-polyphosphate combinations of this invention than alone without precipitation of calcium orthophosphate. Since the present inhibitor systems are effective over wide ranges of cooling water pH, it is not necessary to control the cooling water pH as precisely as in presently used corrosion inhibitor systems in order to avoid calcium carbonate formation. A still further advantage of the gluconate-polyphosphate inhibitor systems of this invention is that protective films on metal surfaces formed with these inhibitor systems maintain their integrity for a substantial period of time, e.g., a month or longer, even if the supply of corrosion inhibitor is cut off entirely and water containing no corrosion inhibitor is recirculated. In contrast, protective films formed with previously known inhibitors such as chromates are quickly destroyed if the inhibitor is withdrawn entirely or if the inhibitor concentration is lowered below a minimum concentration.

The sole FIGURE of the drawing illustrates the striking effectiveness of gluconate-polyphosphate mixtures as corrosion inhibitors in aqueous media. This FIGURE is a graph showing corrosion inhibitor efficiency in percent as a function of the weight ratio of sodium gluconate to total corrosion inhibitor (i.e., sodium gluconate plus sodium hexametaphosphate) at various total inhibitor concentrations. The experiments were carried out in air-saturated water at 120° F. for four days using 1020 carbon steel test specimens. Inhibitor efficiency is defined by the equation:

$$\% \text{ Inhibitor Efficiency} = \frac{I_o - I}{I_o} \times 100$$

when $I_o$ is the corrosion rate without and I is the corrosion rate with inhibitor. The solid lines show actual inhibitor efficiencies, and the dotted lines show the efficiencies which would be predicted in the absence of synergism. This graph shows that sodium gluconate by itself is not effective as a corrosion inhibitor at concentrations substantially less than 100 ppm. Sodium hexametaphosphate is shown to be an effective corrosion inhibitor at all concentrations tested (50 ppm, 100 ppm and 200 ppm) but is not desirable when used alone for the reasons previously mentioned. Mixtures of a water-soluble gluconate and a water-soluble polyphosphate, particularly those containing from about 30 to about 90% by weight of gluconate and conversely about 70 to about 10% of polyphosphate, based on the total weight of inhibitor present, are shown to exhibit a synergistic improvement in corrosion inhibition.

The present invention will be described more fully with reference to the following examples.

EXAMPLE 1

This example demonstrates the efficacy of a mixture of sodium gluconate and sodium hexametaphosphate as an inhibitor of oxidative corrosion in carbon steel exposed to water saturated with dissolved oxygen. The test procedure involves placing a small specimen of known weight of 1020 carbon steel ($1 \times 4 \times \frac{1}{8}$ inch) in water through which air is constantly being bubbled. The concentration of dissolved oxygen will thus be kept at a very high level and will duplicate a long period of exposure of the metal in a cooling water system environment. A second specimen of 1020 carbon steel of known weight is placed in water which is also saturated with air by means of a bubbler. A desired quantity of the corrosion inhibitor is dissolved in this water. The temperature of both the blank and the test solutions is maintained at 120° F.

The specimens before their introduction in the test solution are abraded through 4-0 emery paper, degreased in benzene, pickled in dilute sulfuric acid and washed in distilled water. Immediately after drying the specimens are weighed and placed in the test solution.

After the desired test period of about 4 days, the samples are removed, cleaned with a soft brush, washed with water, then acetone, and are weighed after drying. The amount of the corroded metal is determined by weight loss by weighing before and after the test and the corrosion rate is calculated in milligrams per square decimeter per day (mdd.). The effectiveness of an inhibitor to reduce corrosion is expressed as percent inhibitor efficiency as given by the equation:

$$E = \frac{I_o - I_i}{I_o} \times 100$$

where $E$ is % corrosion inhibitor efficiency, $I_o$ is the corrosion rate without inhibitor and $I_i$ is the corrosion rate with inhibitor.

The results of representative experiments utilizing the above procedure are summarized in Table I below. They are also shown graphically in the sole FIGURE of the drawing.

TABLE I

Effect of Mixtures of Sodium Gluconate and Sodium Hexametaphosphate on Corrosion of 1020 Carbon Steel in Air Saturated Tap Water at 120° F.

| Inhibitor | Conc. ppm. | Corrosion Rate, mdd. | % Inhibitor Efficiency |
|---|---|---|---|
| *Blank | — | 77.5 | — |
| Sodium Gluconate + Sodium Hexametaphosphate | 200 200 | 0.60 | 99.3 |
| *Sodium Gluconate | 200 | 22.8 | 70.5 |

TABLE I-continued

Effect of Mixtures of Sodium Gluconate and Sodium Hexametaphosphate on Corrosion of 1020 Carbon Steel in Air Saturated Tap Water at 120° F.

| Inhibitor | Conc. ppm. | Corrosion Rate, mdd. | % Inhibitor Efficiency |
|---|---|---|---|
| *Sodium Hexametaphosphate | 200 | 3.73 | 95.3 |
| Sodium Gluconate + Sodium Hexametaphosphate | 100 100 | 1.60 | 98.0 |
| Sodium Gluconate + Sodium Hexametaphosphate | 160 40 | 0.70 | 99.1 |
| *Sodium Gluconate | 100 | 28.5 | 63.5 |
| *Sodium Hexametaphosphate | 100 | 11.16 | 85.7 |
| Sodium Gluconate + Sodium Hexametaphosphate | 20 80 | 11.0 | 85.8 |
| Sodium Gluconate + Sodium Hexametaphosphate | 50 50 | 8.97 | 88.6 |
| Sodium Gluconate + Sodium Hexametaphosphate | 80 20 | 4.36 | 94.3 |
| *Sodium Gluconate | 50 | 78.4 | ~0 |
| *Sodium Hexametaphosphate | 50 | 19.4 | 75 |
| Sodium Gluconate + Sodium Hexametaphosphate | 10 40 | 29.8 | 61.4 |
| Sodium Gluconate + Sodium Hexametaphosphate | 25 25 | 24.1 | 69 |
| Sodium Gluconate + Sodium Hexametaphosphate | 40 10 | 45.6 | 28.2 |

*Comparison Run

It will be appreciated that the concentrations in this table represent desirable initial concentrations of corrosion inhibitor. Suitable maintenance concentrations can be lower as has been discussed previously and also shown hereinafter. The data in Table I and the sole FIGURE show that at initial inhibitor concentrations (pretreatment concentration) of about 100 ppm, and higher, considerable synergism is exhibited between gluconate and hexametaphosphate, i.e., corrosion inhibitor efficiency for the mixture is much higher than for each of the ingredients of the inhibitor formulation or the arithmetic average as shown by the dotted line. The same synergism is exhibited in lower maintenance concentration of 50 ppm of the gluconate-hexametaphosphate inhibitor mixture as can be seen by comparing the data shown in the following Examples 2 and 3.

EXAMPLE 2

This example demonstrates the efficacy of a mixture of a water-soluble ammonium gluconate and sodium hexametaphosphate. The procedure of Example 1 was followed except that the tests in this example were run for a period of 10 days. The results are given below in Table II.

TABLE II

Effect of Mixtures of Ammonium Gluconate and Sodium Hexametaphosphate on Corrosion of 1020 Carbon Steel in Air Saturated Tap Water at 120° F.

| Inhibitor | Conc. ppm. | Corrosion Rate mdd. | % Inhibitor Efficiency |
|---|---|---|---|
| *Blank | — | 100.5 | — |
| Ammonium Gluconate + Sodium Hexametaphosphate | 50 50 | 19.5 | 80.5 |
| Ammonium Gluconate + Sodium Hexametaphosphate | 100 100 | 7.0 | 93 |

*Comparison Run

EXAMPLE 3

This example demonstrates the effect of pretreatment with a higher initial concentration of gluconate-hexametaphosphate inhibitor on corrosion of 1020 carbon steel in air saturated tap water at 120° F. The procedure followed was similar to that used in Example 1, except that the test specimens were first placed in a pretreatment solution for about 10 days and subsequently they were placed in a maintenance solution for an additional 40 days, for a total of 50 days exposure. Both the pretreatment and maintenance solutions were saturated with air by continuous air bubbling throughout the test. Corrosion rates were calculated in milligrams per square decimeter per day (mdd), by weighing the test specimens before and after the test. The results of representative experiments utilizing the above procedure are shown in Table III. The results show that much lower corrosion rates are obtained than those shown in Tables I and II with a maintenance inhibitor concentration of 50 ppm (gluconate + hexametaphosphate) when the test specimens are exposured initially to a higher pretreatment inhibitor concentration.

TABLE III

Effect of Pretreatment with Higher Initial Concentration of Gluconate-Hexametaphosphate on Corrosion of 1020 Carbon Steel in Air Saturated Tap Water at 120° F.

| Inhibitor | Inhibitor Pretreatment | Concentration (ppm) Maintenance | Corrosion** Rate, mdd | % Inhibitor Efficiency |
|---|---|---|---|---|
| *Blank | — | — | 112 | — |
| Sodium Gluconate + Sodium Hexametaphosphate | 100 100 | 30 20 | 15.2 | 86.3 |
| Ammonium Gluconate + Sodium Hexametaphosphate | 100 100 | 30 20 | 9.5 | 91.5 |

*Comparison Run.
**Average corrosion rates based on weight loss measurements on two test specimens.

EXAMPLE 4

This example demonstrates the efficacy of a mixture of a water-soluble gluconate, a water-soluble zinc salt, and sodium hexametaphosphate. The procedure of Example 1 was followed except that the tests in this example were run at both 77° F. and 120° F. for a period of 7 days.

The results of representative experiments are summarized in Table IV below.

TABLE IV

Inhibition of Corrosion of Carbon Steel In Aerated Tap Water (7 Days Runs)

| Inhibitor | Concentration (ppm) | Temp., ° F. | Corrosion Rate mg/dm²/day |
|---|---|---|---|
| Blank | | 77 | 28 |
| Sodium Gluconate + Zinc Sulfate + Sodium Hexameta- | 80 9 20 | 77 | 14.8 |

TABLE IV-continued

| Inhibition of Corrosion of Carbon Steel In Aerated Tap Water (7 Days Runs) | | | |
|---|---|---|---|
| Inhibitor | Concentration (ppm) | Temp., ° F. | Corrosion Rate mg/dm²/day |
| phosphate | | | |
| Sodium Gluconate + Zinc Sulfate + Sodium Hexametaphosphate | 160 9 40 | 77 | 11.0 |
| Blank | | 120 | 79.5 |
| Sodium Gluconate + Zinc Sulfate + Sodium Hexametaphosphate | 80 9 20 | 120 | 25.2 |
| Sodium Gluconate + Zinc Sulfate + Sodium Hexametaphosphate | 160 9 40 | 120 | 28.4 |

EXAMPLE 5

This example demonstrates the efficacy of a mixture of a water-soluble gluconate, an alkali metal silicate, and sodium hexametaphosphate. The alkali metal silicate was commercial sodium silicate having an $Na_2O:SiO_2$ mole ratio of 1:1. Tests were run at 120° F. following the procedure of Example 1.

Results of representative experiments are given in Table V below.

TABLE V

| Inhibitor | Conc. ppm. | Corrosion Rate, Mils/Year | % Inhibitor Efficiency |
|---|---|---|---|
| Blank | — | 18.8 | 0 |
| Sodium Silicate + Sodium Gluconate + Sodium Hexametaphosphate | 50 25 25 | 5.7 | 70 |

What is claimed is:

1. A method for inhibiting oxidative corrosion of metal parts in a recirculating cooling water system having dissolved oxygen and chlorine therein, which comprises adding to said water a corrosion inhibitor composition comprised of about 30 to about 90 parts by weight of an alkali metal or ammonium gluconate and about 70 to about 10 parts by weight of a polyphosphate, wherein said added polyphosphate is selected from the group consisting of alkali metal polyphosphate and ammonium polyphosphate, the combined concentration of said gluconate and said polyphosphate being at least 25 ppm.

2. A method according to claim 1 in which said cooling water is substantially free from oxidizable organic matter.

3. A method according to claim 2 in which said polyphosphate is a hexametaphosphate.

4. A method according to claim 3 in which said polyphosphate is sodium hexametaphosphate.

5. A method according to claim 4 in which said gluconate is sodium gluconate.

6. A method according to claim 1 in which the combined concentration of said polyphosphate and said gluconate in said system is in the range of about 50 to about 200 ppm.

7. A method according to claim 1 in which said gluconate and said polyphosphate are added in the proportion of about 30 to about 80 parts by weight of said gluconate and about 70 to about 20 parts by weight of said polyphosphate.

8. A method for inhibiting oxidative corrosion of metal parts in a recirculating cooling water system having dissolved oxygen therein which comprises adding to said water (1) chlorine or a compound thereof in an amount sufficient to retard bacterial growth therein and (2) a corrosion inhibitor composition comprising about 30 to about 90 parts by weight of an alkali metal or ammonium gluconate and about 70 to about 10 parts by weight of an alkali metal or ammonium polyphosphate, the combined concentrations of said gluconate and said polyphosphate being at least 25 ppm.

9. A method according to claim 8 in which the combined concentration of said polyphosphate and said gluconate in said system is in the range of about 50 to about 200 ppm.

10. A method according to claim 9 in which said gluconate is sodium gluconate and said polyphosphate is sodium hexametaphosphate.

11. A cooling water solution having dissolved oxygen and chlorine therein inhibited against oxidative corrosion of metals, said solution being substantially free from organic matter oxidizable by chlorine in an aqueous medium and comprising a major amount of water and minor amounts of a polyphosphate and an alkali metal or ammonium gluconate wherein said polyphosphate is selected from the group consisting of the alkali metal polyphosphates and ammonium polyphosphate, said polyphosphate and said gluconate being present in the proportion of about 30 to about 90 parts by weight of said gluconate and about 70 to about 10 parts by weight of said polyphosphate, the combined concentration of said polyphosphate and said gluconate being at least about 25 ppm.

12. A cooling water solution according to claim 11 in which the combined concentration of said polyphosphate and said gluconate is about 50 to about 200 ppm.

13. A corrosion inhibiting concentrated aqueous solution for addition to cooling water systems having dissolved oxygen and chlorine, said concentrated solution being substantially free from organic matter oxidizable by chlorine in an aqueous medium and comprising a major amount of water and a minor amount of a corrosion inhibitor composition consisting essentially of a polyphosphate and an alkali metal or ammonium gluconate wherein said polyphosphate is selected from the group consisting of the alkali metal polyphosphates and ammonium polyphosphate, said polyphosphate and said gluconate being present in the proportion of about 30 to about 90 parts by weight of said gluconate and about 70 to about 10 parts by weight of said polyphosphate, the combined concentration of said polyphosphate and said gluconate being at least about 25 ppm.

* * * * *